US005423470A

United States Patent [19]

Kawada

[11] Patent Number: 5,423,470

[45] Date of Patent: Jun. 13, 1995

[54] STAPLE FASTENING INSTRUMENT

[75] Inventor: Toshikazu Kawada, Tokyo, Japan

[73] Assignee: Towa Seiko Co., Ltd., Tokyo, Japan

[21] Appl. No.: 290,281

[22] Filed: Aug. 8, 1994

[30] Foreign Application Priority Data

Aug. 11, 1993 [JP] Japan ..... 5-199569
Aug. 25, 1993 [JP] Japan ..... 5-210146

[51] Int. Cl.[6] ..... B65C 7/00
[52] U.S. Cl. ..... 227/67
[58] Field of Search ..... 227/67, 71

[56] References Cited

U.S. PATENT DOCUMENTS 3,924,788 12/1975 Furutu .
4,718,460 1/1988 Sato ..... 227/67
4,819,855 4/1989 Satoh et al. ..... 227/67
5,033,664 7/1991 Bone et al. ..... 227/67

FOREIGN PATENT DOCUMENTS 63-281940 11/1988 Japan .

*Primary Examiner*—Scott A. Smith
*Attorney, Agent, or Firm*—Nikaido, Marmelstein, Murray & Oram

[57] ABSTRACT

Disclosed is an improved hand instrument for driving staples in the form of small bits of string into sheets of soft material comprising a handgun-like body composed of a grip having a hand-operated lever fixed therein and a string ejection barrel having a hollow needle fixed at its outlet end and a slidable push rod fixed therein. The hand-operated lever is so operatively connected to the push rod that the push rod is driven and inserted in the hollow needle to eject small bits of string one after another from the hollow needle every time the hand-operated lever is pressed. The hand instrument uses a composite resilient mechanism to permit application to the hand-operated lever a fixed value of return force, thereby assuring that the hand-operated lever is used by applying a fixed value of pressing force thereto, and that one does not get much tired after using the stapler many hundred times without intermission.

3 Claims, 5 Drawing Sheets

STAPLE FASTENING INSTRUMENT

BACKGROUND OF THE INVENTION

1. Field of the Invention

The present invention relates to an improvement in or relating to a staple fastening instrument or a hand instrument for driving staples in the form of small bits of nylon or other resin string (Called "tag pins" or "nylon pins") into sheets of soft material such as selected parts of clothes or other goods for fixing tags or connecting together.

2. Description of Related Art

As shown in Japanese Patent 63-281940(A) and U.S. Pat. No. 3,924,788, such a hand instrument uses a single spring to cause a hand-operated lever to return to its original position after driving and ejecting a bit of nylon resin string from its hollow needle.

The counter resilient force which is applied to the hand-operated lever so as to pull it toward its original position will increase linearly with the increase of travelling distance of the hand-operated lever in driving and ejecting a bit of nylon resin string from its hollow needle. The difference between the minimum load on the hand-operated lever at the initial point and the maximum load thereon at the final position of the travelling path of the hand-operated lever is so large that one's hand and arm gets badly tired after operating the hand-operated lever many hundred times, and in the worst situation one may suffer from tendovaginitis.

SUMMARY OF THE INVENTION

One object of the present invention is to provide a staple fastening instrument or hand instrument for driving staples in the form of small bits of string into sheets of soft material of selected parts of clothes and other goods, and for fixing tags on clothes and other goods or connecting together without fear of causing great tiredness in one's hand or arm even after using many times without intermission.

This and other objects can be attained by designing such hand instruments so as to keep the load or work done by hand at a substantially fixed amount over the travelling distance of the hand-operated lever, and by reducing the maximum load to possible smallest amount.

Specifically a hand instrument for driving staples in the form of small bits of string into sheets of soft material comprising a handgun-like body composed of a grip having an operating lever fixed therein and a string ejection barrel having a hollow needle fixed at its outlet end and a slidable push rod fixed therein, said operating lever being so operatively connected to said push rod that said push rod is driven and inserted in said hollow needle to eject small bits of string one after another from said hollow needle every time said operating lever is pressed, is improved according to the present invention in that it comprises an actuating lever connected to said operating lever and spring-biased to cause it to rotate over a predetermined angle about its pivot axle for urging said operating lever forward all the time, said actuating lever being connected to said push rod for driving it back and forth; and a composite resilient mechanism for urging said operating lever toward its original position, said composite resilient mechanism comprising a first spring means to urge said actuating lever toward its original position with a force increasing linearly with the increase of rotation angle and a second spring means to apply to said actuating lever a resilient force which becomes zero at the intermediate point of rotation, increasing in one direction on the way to the initial point beyond the intermediate point of rotation, and increasing in the other direction on the way to the final point beyond the intermediate point of rotation.

The second spring means is stretched between a catch pin fixed to the actuating lever close to its upper end apart from its pivot axle and a first stationary pin fixed to the grip close to the rear side of the grip apart from the pivot axle of the actuating lever.

The first spring means is stretched between the catch pin fixed to the actuating lever close to its upper end apart from its pivot axle and a second stationary pin fixed to the grip close to the lower end of the actuating lever. The actuating lever has an arc slot made on an imaginary circle drawn with its center on the pivot axle of the actuating lever, and the second stationary pin is loosely fitted in the arc slot of the actuating lever, thereby permitting the actuating lever to rotate a predetermined angle about its pivot axle.

Other objects and advantages of the present invention will be understood from the following description of a tagging instrument according to the present invention, which is shown in accompanying drawings.

DESCRIPTION OF THE PREFERRED EMBODIMENTS

Figure 1:
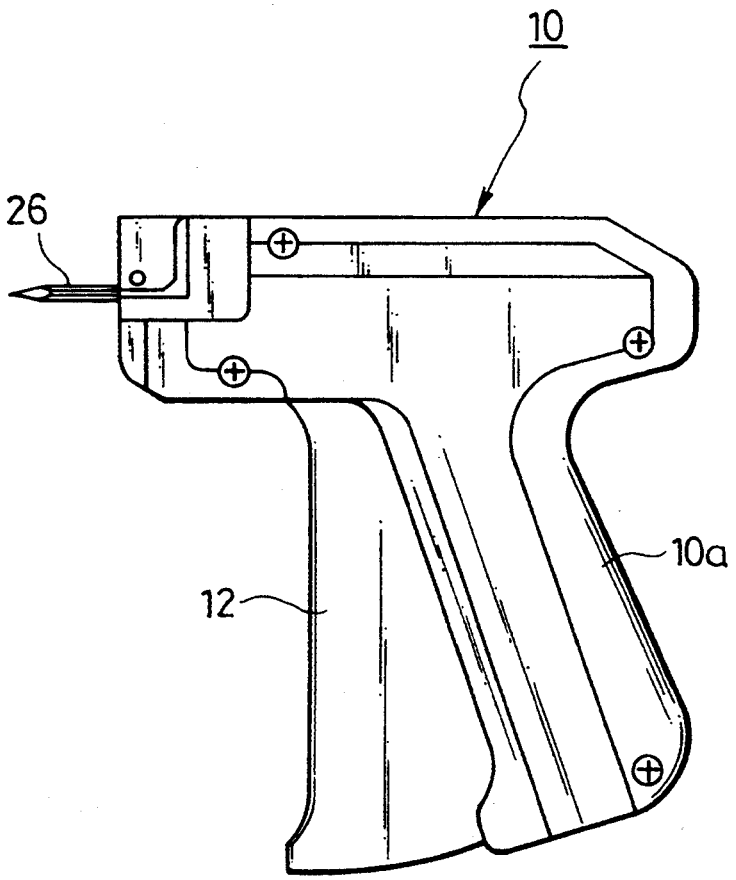
FIG. 1 shows diagrammatically a tagging instrument according to one embodiment of the present invention.
Figure 2:
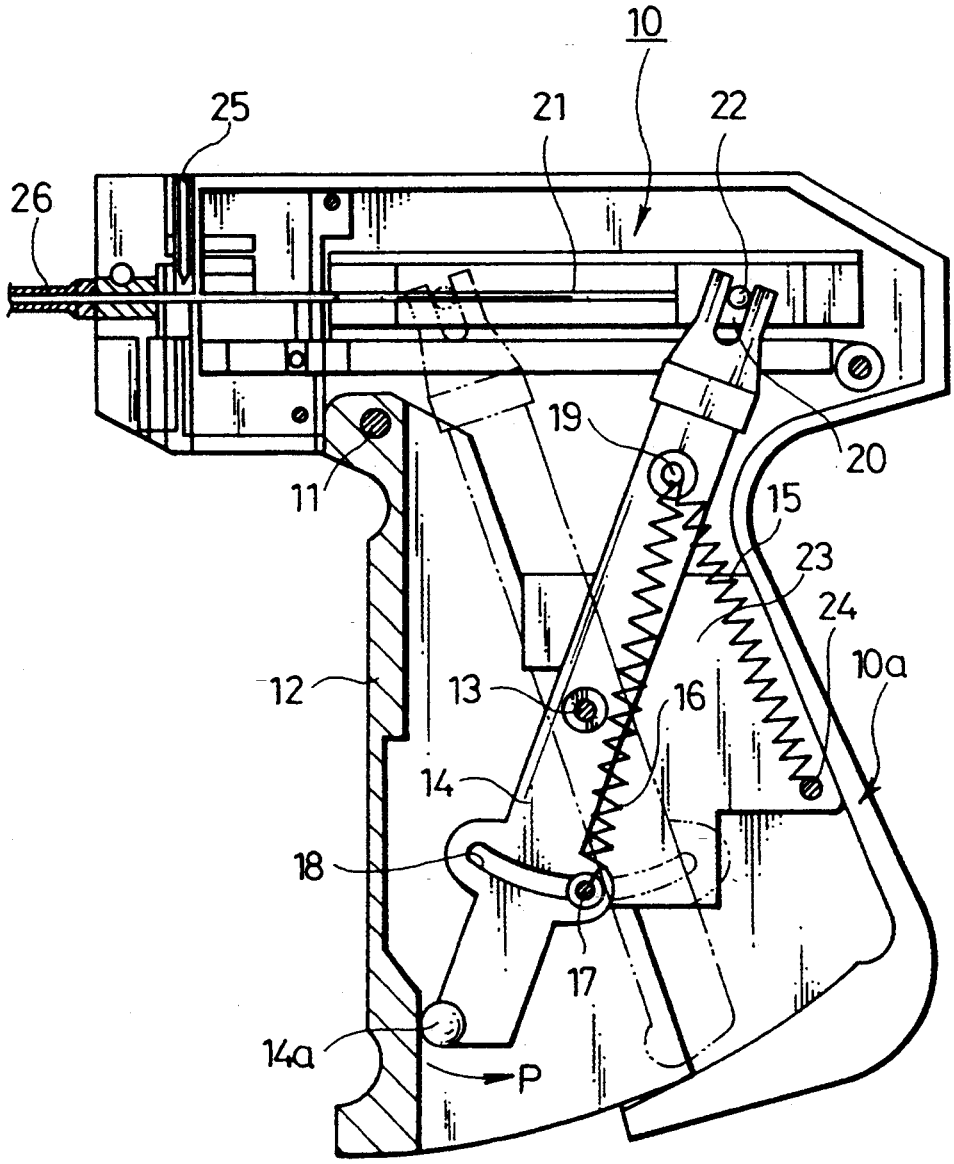
FIG. 2 is a longitudinal section of the tagging instrument.
Figure 6:
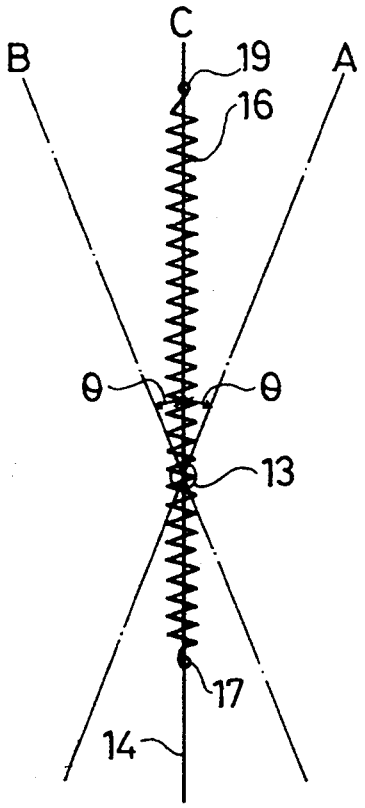
FIG. 6 shows diagrammatically the positional relation between the actuating lever and the second spring at the intermediate point C.

Referring to FIGS. 1 and 2, a handgun-like body 10 has a hand-operated lever 12 fixed thereto to rotate about a pivot axle 11. The grip 10*a* of the handgun-like body 10 contains an actuating lever 14 and a composite resilient mechanism to urge the actuated lever 14 toward its original position. Specifically, the spring-biased actuating lever 14 when pressed, will yieldingly rotate a predetermined angle about its pivot axle 13, starting from the original or initial position (solid line) and reaching at the final position (broken line). The composite resilient mechanism is composed of a first spring 15 and a second spring 16. The first spring 15 urges the actuating lever 14 with the counter or return force increasing linearly with the increase of the rotational angle of the actuating lever 14 (see FIG. 3). On the other hand the second spring 16 urges the actuating lever 14 with the counter or return force which decreases gradually as the actuating lever 14 turns from the initial point A toward the intermediate point C at which the catch pin 19, the pivot axle 13 and the stationary pin 17 are aligned together (see FIG. 6), and once the actuating lever 13 begins turning beyond the intermediate point C, the second spring 16 urges the actuating lever 14 with the pressing or advance force which increases gradually with the increase of rotation of the actuating lever 14 (see FIG. 4).

As seen from FIG. 1, the actuating lever 14 has a cylindrical abutment 14*a* at its lower, left corner to abut against the hand-operated lever 12, and it has an are slot 18 below its pivot axle 13. The are slot 18 extends on a part of the imaginary cycle drawn with its center on the pivot axle 13, and a stationary pin 17 is loosely fitted in the are slot 18 of the actuating lever 14. The actuating lever 14 has a catch pin 19 fixed at its upper end, and first and second springs 15 and 16 are fixed to the catch pin 19 at their one ends. In addition, the actuating lever 14 has a U-Shape notch 20 made at its upper end, and in the U-Shape notch 20 there is loosely fitted a pin 22, which is fixed to the rear end of a push rod 21 in the barrel of the handgun-like body 10.

By pressing the hand-operated lever 12 the actuating lever 14 is made to rotate about its pivot axle 13 in the direction as indicated by arrow P. The pivot axle 13 rises from a stationary plate 23 fixed to one inner surface of the grip 10*a* of the handgun-like body 10.

Also, a stationary pin 24 is fixed to the stationary plate 23, and the first spring 15 is stretched between the stationary pin 24 and the catch pin 19, which is fixed to the actuating lever 14. The second spring 16 is stretched between the stationary pin 17 and the catch pin 19.

A staple magazine in the barrel of the handgun-like body has a guide slot 25 loaded with a series of small bits of nylon string. A bit of nylon string is selected from the bottom of the pile series to be ejected from the hollow needle 26 one after another every time the push rod 21 is driven forward.

Figure 3:
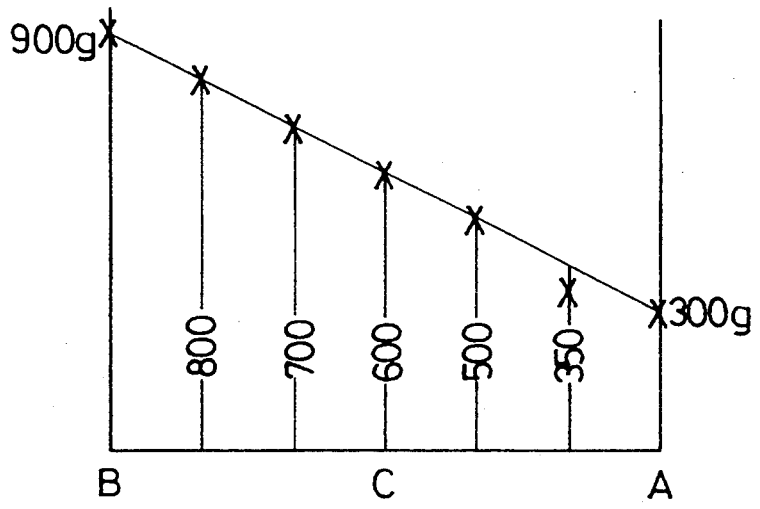
FIG. 3 shows how the resilient force of the first spring varies with the travelling distance of the actuating lever on the way from its final to original position.

Now, referring to FIGS. 3 to 9, the function of the composite resilient mechanism is described. FIG. 3 shows how the energizing force which is applied by the first spring 15 to the lower end of the actuating lever 13, that is, the load component on the hand-operated lever 12 varies while the lower end of the actuating lever 13 moves from the initial point A to the final point B. In this particular embodiment the initial value is set to be 300 grams, and the energizing force increases linearly from 300 grams at Point A to 900 grams at Point B.

Figure 4:
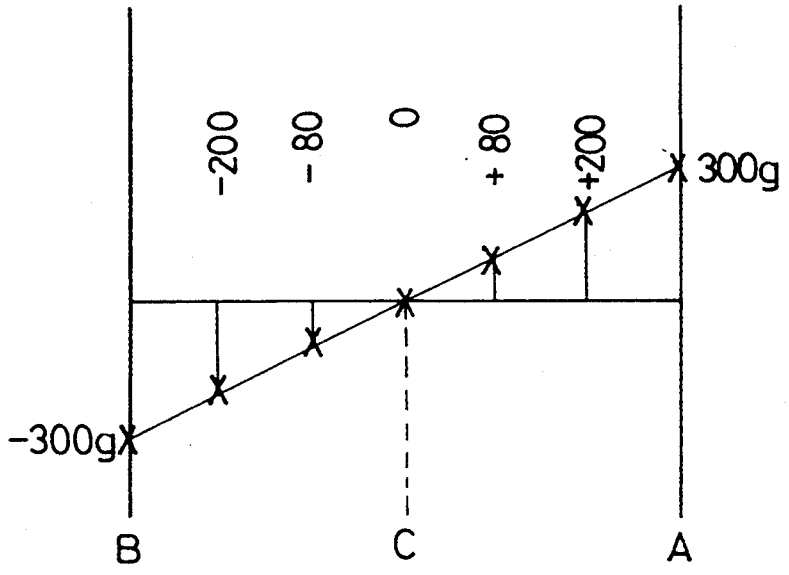
FIG. 4 shows how the resilient force of the second spring varies with the travelling distance of the actuating lever on the way from its final to original position.

FIGS. 4 to 7 show how the second spring 16 applies its energizing force to the actuating lever 14. Particularly FIG. 4 shows how the energizing force applied to the actuating lever 14 by the second spring 16 varies with angular displacement of the actuating lever 14, that is, how the load component on the hand-operated lever 12 varies. As shown, it is 300 grams at the initial point A; 0 grams at the intermediate point C at which the fixed pin 17, the pivot axle 13 and the catch pin 19 are aligned together; and −300 grams at the final point B.

Figure 5:
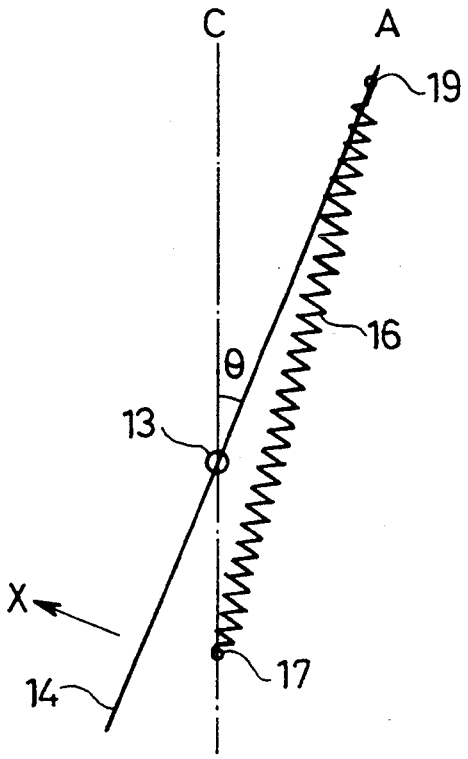
FIG. 5 shows diagrammatically the positional relation between the actuating lever and the second spring at the initial point A.

As shown in FIG. 5, when the actuating lever 14 rests on the initial point A (solid line in FIG. 1), the second spring 16 applies its resilient force to rotate the actuating lever 14 in the direction indicated by arrow X, thus keeping the actuating lever at the rest position. At this initial point A the return force which is applied to the push rod 21 to keep or bring it toward its original position, that is, the initial load component on the hand-operated lever 12 is 300 grams (maximum), gradually decreasing until the return force is zero at at the intermediate point C (FIG. 6) at which the fixed pin 17, the pivot axle 13 and the catch pin 19 are aligned together.

Figure 7:
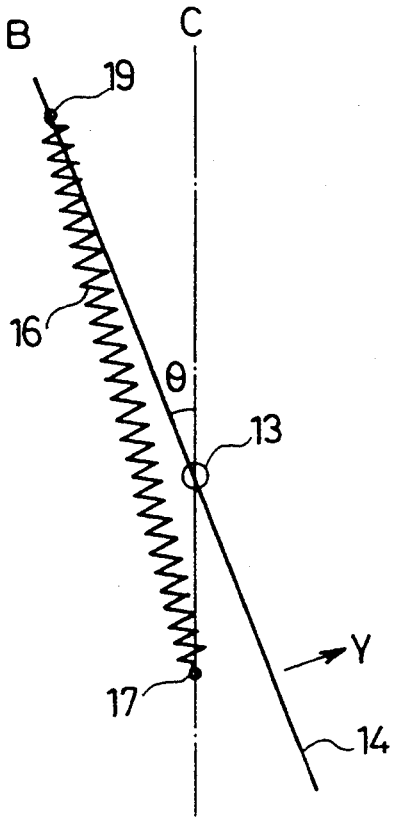
FIG. 7 shows diagrammatically the positional relation between the actuating lever and the second spring at the final point B.

As shown in FIG. 7, when the actuating lever 14 rotates beyond the intermediate point C, the energizing force of the second spring 16 is directed in the direction indicated by arrow Y, just opposite to the direction in which it is directed on the side of the initial point A. The energizing force with which the actuating lever 14 pushes the push rod 21 increases to maximum (300 grams) at the final point B. This is a maximum value of force (−300 grams) in the negative direction as viewed from the point of return force to bring the actuating lever 14 to its original position.

Figure 8:
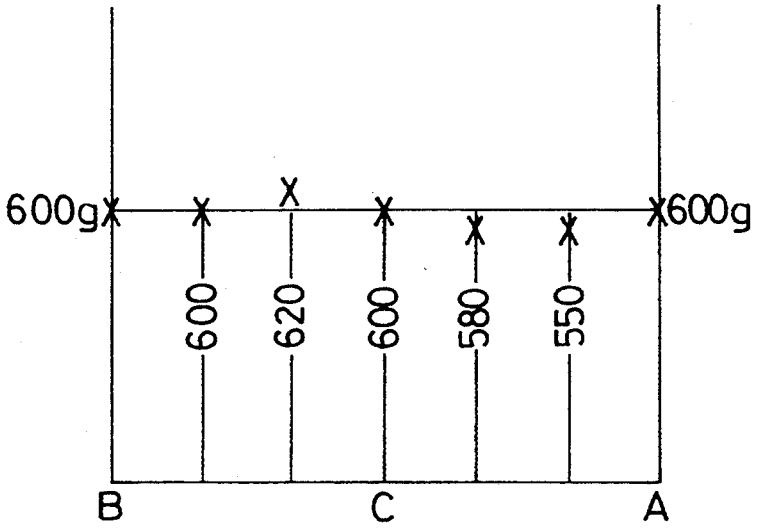
FIG. 8 shows how the resilient force of the composite resilient mechanism to drive the hand-operated lever toward its original position varies with the travelling distance of the actuating lever.

The resultant energizing force of the first and second springs 15 and 16 applied to the actuating lever 14 varies as shown in FIG. 8. As seen from FIG. 8, the return force which is applied to the actuating lever 14 by the composite resilient mechanism, that is, the load on the hand-operated lever 12 remains at a substantially constant value around 600 grams from the initial point A to the final point B.

Now, the tagging operation is described. The guide slot 25 is loaded with small bits of string, and the hand-operated lever 12 is pressed to push the lower end of the actuating lever 14, thereby causing the actuating lever 14 to rotate about the pivot axle 13. The rotating force is converted to the pushing force through the agency of the pin 22 loosely fitted in the notch 20 of the upper end of the actuating lever 14, thus pushing the push rod 21 forward.

Small bits of string are driven one after another into selected parts of sheets of soft material of cloths or other goods, thus attaching tags to such cloths or other goods. While driving small bits of string, the load on the hand-operated lever 12 remains at a fixed value of about 600 grams. When releasing the hand-operated lever 12, the actuating lever 14 returns to the initial point A under the influence of resultant resilient force of 600 grams, and at the same time, the hand-operated lever 12 returns to the original position.

As may be understood from the above, the load on the hand-operated lever remains constant in operation, and the maximum load is smaller than that which would be if a single spring were used. For these reasons one does not get tired so much in hand after using the tagging instrument many hundred times without intermission.

The essential feature of the present invention resides in use of the composite resilient mechanism, which can be advantageously applied to similar instruments to assure application of constant driving force in operation, and therefore, the present invention should not be understood to be limitative to the tagging instrument described above, but other instruments using the composite resilient mechanism according to the present invention fall within the scope of the present invention. Also, the tagging instrument described above can be modified without departing the spirit of the present invention.

I claim:

1. A hand instrument for driving staples in the form of small bits of string into sheets of soft material comprising; a handgun-like body composed of a grip having a hand-operated lever fixed therein and a string ejection barrel having a hollow needle fixed at its outlet end and a slidable push rod fixed therein, said hand-operated lever being so operatively connected to said push rod that said push rod is driven and inserted in said hollow needle to eject small bits of string one after another from said hollow needle every time said hand-operated lever is pressed, characterized in that said hand instrument comprises an actuating lever connected to said hand-operated lever and spring-biased to cause said actuating lever to rotate over a predetermined angle about a pivot axle for urging said hand-operated lever forward, said actuating lever being connected to said push rod for driving said push rod back and forth; and a composite resilient mechanism for urging said hand-operated lever toward its original position, said composite resilient mechanism comprising a first spring means to urge said actuating lever toward a forward position with a force increasing linearly with an increase of rotation angle of said actuating lever and a second spring means to apply to said actuating lever a resilient force which becomes zero at an intermediate point of rotation of said actuating lever, increasing in one direction toward an initial point beyond the intermediate point of rotation of said actuating lever, and increasing in an opposite direction toward a final point beyond the intermediate point of rotation.

2. A hand instrument for driving small bits of string into sheets of soft material according to claim 1, wherein said first spring means is stretched between a catch pin fixed to the actuating lever near an upper end spaced apart from its pivot axle and a first stationary pin fixed to the grip adjacent a rear side of the grip spaced apart from the pivot axle of the actuating lever.

3. A hand instrument for driving small bits of string into sheets of soft material according to claim 1, wherein said second spring means is stretched between a catch pin fixed to the actuating lever near an upper end spaced apart from its pivot axle and a second stationary pin fixed to the grip adjacent a lower end of the actuating lever.

* * * * *